US010246886B2

(12) United States Patent
Mitchell

(10) Patent No.: US 10,246,886 B2
(45) Date of Patent: Apr. 2, 2019

(54) ADJUSTABLE SHIM AND PRE-HUNG DOOR WITH THE SAME

(71) Applicant: Endura Products, Inc., Colfax, NC (US)

(72) Inventor: Michael K. Mitchell, Winston-Salem, NC (US)

(73) Assignee: Endura Products, Inc., Colfax, NC (US)

( * ) Notice: Subject to any disclaimer, the term of this patent is extended or adjusted under 35 U.S.C. 154(b) by 0 days.

(21) Appl. No.: 15/392,141

(22) Filed: Dec. 28, 2016

(65) Prior Publication Data

US 2017/0204653 A1 Jul. 20, 2017

Related U.S. Application Data

(60) Provisional application No. 62/279,031, filed on Jan. 15, 2016.

(51) Int. Cl.
*E04F 21/00* (2006.01)
*E06B 3/70* (2006.01)

(52) U.S. Cl.
CPC .. *E04F 21/0015* (2013.01); *E06B 2003/7098* (2013.01)

(58) Field of Classification Search
CPC ..... E06B 1/6015; E06B 1/60; E06B 1/6023; E06B 1/603; E06B 1/6046; E06B 1/6069; E06B 1/6076; E06B 1/04; E06B 1/045; E06B 1/62; E06B 1/18; E06B 1/20; E06B 2001/622; E04F 21/0015; E04F 21/0023; E04F 21/0007
USPC ..... 52/126.3, 126.4, 215, 217
See application file for complete search history.

(56) References Cited

U.S. PATENT DOCUMENTS 2,524,961 A * 10/1950 Cramer, Jr. ..... F01B 17/04 254/104
3,250,049 A * 5/1966 Sklar ..... E06B 1/6061 52/211
3,571,996 A 3/1971 Braswell
3,992,833 A 11/1976 Hulinsky
4,232,068 A 11/1980 Hoh et al.
4,637,183 A * 1/1987 Metz ..... E05D 5/0238 49/504
4,731,965 A 3/1988 Jensen
(Continued)

FOREIGN PATENT DOCUMENTS

WO 2012155908 11/2012

OTHER PUBLICATIONS

Truth Hardware catalog, Windows & Doors, Jamb Jacks, known at least as early as Jan. 14, 2016, 4 pgs.

*Primary Examiner* — Jessica L Laux
(74) *Attorney, Agent, or Firm* — Womble Bond Dickinson (US) LLP

(57) ABSTRACT

An adjustable shim is described for attachment to a pre-hung door or a rough opening. The adjustable shim may include a base bracket for mounting the adjustable shim to the pre-hung door or the rough opening, an inner shim, an outer shim, and a first actuator operably attached between the base bracket and the inner shim. At least one of the inner shim and the outer shim is tapered. Rotation of the first actuator translates the inner shim substantially linearly relative to the outer shim, thereby adjusting a combined height of the inner shim and the outer shim.

20 Claims, 12 Drawing Sheets

(56) References Cited

U.S. PATENT DOCUMENTS

| | | | | |
|---|---|---|---|---|
| 4,739,561 | A | 4/1988 | Mills | |
| 4,858,386 | A | 8/1989 | Nail | |
| 5,054,250 | A | 10/1991 | Foss | |
| 5,566,414 | A * | 10/1996 | Nonaka | E01D 19/04 14/73.5 |
| 5,655,342 | A | 8/1997 | Guillemet et al. | |
| 5,655,343 | A * | 8/1997 | Seals | E06B 1/603 49/505 |
| 6,018,916 | A * | 2/2000 | Henry | E06B 1/6069 254/104 |
| 6,167,663 | B1 | 1/2001 | Nakamoto et al. | |
| 6,216,402 | B1 | 4/2001 | Van de Laar | |
| 6,966,119 | B1 | 11/2005 | Dlugoleski | |
| 7,331,146 | B1 | 2/2008 | Beutler et al. | |
| 7,537,819 | B2 | 5/2009 | Hendricks | |
| 7,987,637 | B2 | 8/2011 | Smith | |
| 8,813,437 | B1 * | 8/2014 | Spofford | E06B 1/6069 52/126.1 |
| 9,010,065 | B2 | 4/2015 | Brown | |
| 9,010,704 | B2 | 4/2015 | Sirke et al. | |
| 9,194,170 | B2 | 11/2015 | Eis et al. | |
| 2008/0075556 | A1 * | 3/2008 | Smith | E06B 1/6076 411/379 |
| 2008/0276421 | A1 | 11/2008 | Vanderpan | |
| 2010/0058678 | A1 | 3/2010 | Lutz | |
| 2014/0190119 | A1 | 7/2014 | Brown | |

* cited by examiner

ADJUSTABLE SHIM AND PRE-HUNG DOOR WITH THE SAME

TECHNICAL FIELD

The present disclosure relates to building products and components for simplifying installation of building products. More particularly, the present disclosure relates to an adjustable shim for assisting with the installation of pre-hung doors.

BACKGROUND

A common technique for the installation of an exterior door includes the use of a pre-hung door. A typical pre-hung door 10, as shown in FIG. 1, includes a frame 12 and a door panel 14. The frame 12 typically includes a threshold 16, a header 18, a latch-side jamb 20 and a hinge-side jamb 22. A plurality of hinges generally mount the door panel 14 to the hinge-side jamb 22. The pre-hung door 10 may then be installed within a rough opening 24 of a building defined by at least a pair of studs 26 and a cross beam 28 (also known as a header). Sheathing 30, such as oriented strand board (OSB) or plywood may be applied around the rough opening 24 exterior and sheet rock may be applied as sheathing 30 on the interior of the rough opening.

Pre-hung doors 10 (also referred to as door units) are often preferred to separately hanging slab doors, especially for exterior entryways. This is because pre-hung doors 10 are pre-assembled to provide a tight fitting, substantially water-tight seal between the frame 12 and the door panel 14. Pre-hung doors 10, however, can lack rigidity prior to installation. Thus, portions of pre-hung doors 10 have been found to bend, bow, twist, expand, contract or otherwise shift during shipping, handling and installation. These changes can reduce the quality of the pre-assembled seal between the frame 12 and the door panel 14. Returning to proper alignment and spacing between the door panel 14 and the surrounding frame 12 can be highly dependent upon installation practices and the skill of the installers. Properly positioning the pre-hung door 10 within the rough opening 24 can also be highly dependent upon installation practices and the skill of the installers.

To support and position the pre-hung door 10 within the rough opening, tapered shim pairs are conventionally used between the frame 12 and the studs 26. The tapered shim pairs may be used at several locations around the frame 12 to correspond with locations where the frame 12 is fastened around the rough opening 24.

There remains a need for an adjustable shim capable of taking up space between the outside face of the frame 12 and an opposing inside face of the studs 26 such that a pre-hung door 10 may be more easily and accurately supported and positioned within a rough opening 24.

SUMMARY

Embodiments of the present disclosure include an adjustable shim for attachment to a pre-hung door or a rough opening. The adjustable shim may comprise a base bracket configured to mount the adjustable shim to the pre-hung door or the rough opening, an inner shim, an outer shim, and a first actuator operably attached between the base bracket and the inner shim. At least one of the inner shim and the outer shim is tapered. Rotation of the first actuator translates the inner shim substantially linearly relative to the outer shim, thereby adjusting a combined height of the inner shim and the outer shim.

Other embodiments of the present disclosure include methods of installing a pre-hung door within a rough opening in a building. The method may comprise positioning the pre-hung door within the rough opening. The pre-hung door may comprise at least one frame member, and at least one adjustable shim mounted on a back of the at least one frame member. The method may also include rotating a first actuator to relatively translate an inner shim relative to an outer shim of the at least one adjustable shim, at least until the outer shim contacts a portion of the rough opening. The method may also include fastening the pre-hung door to a rough opening frame at a location adjacent to the at least one adjustable shim.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
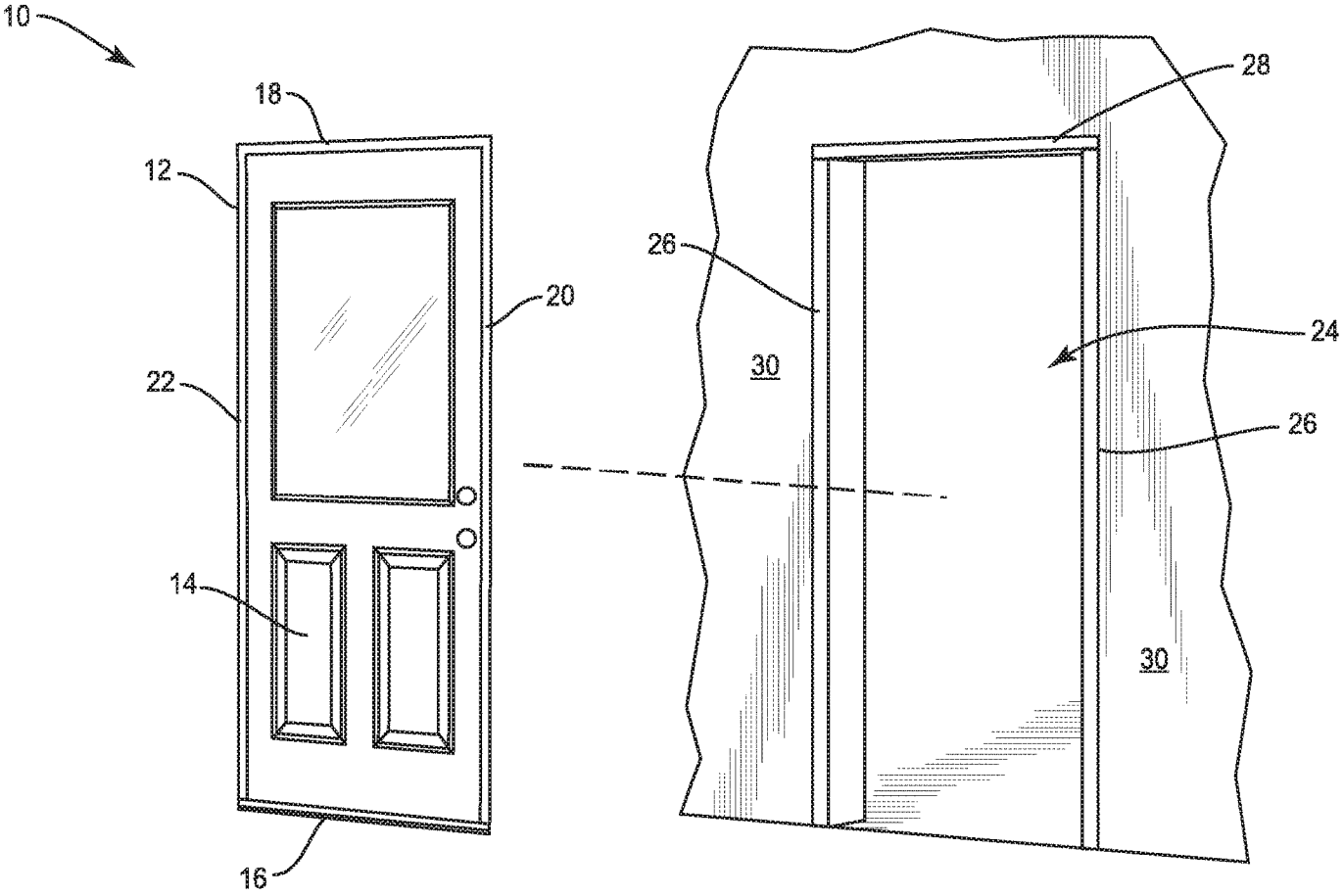
FIG. 1 PRIOR ART
FIG. 1 is an exploded perspective view of a typical pre-hung door being installed into an exterior rough opening of a building.
Figure 2:
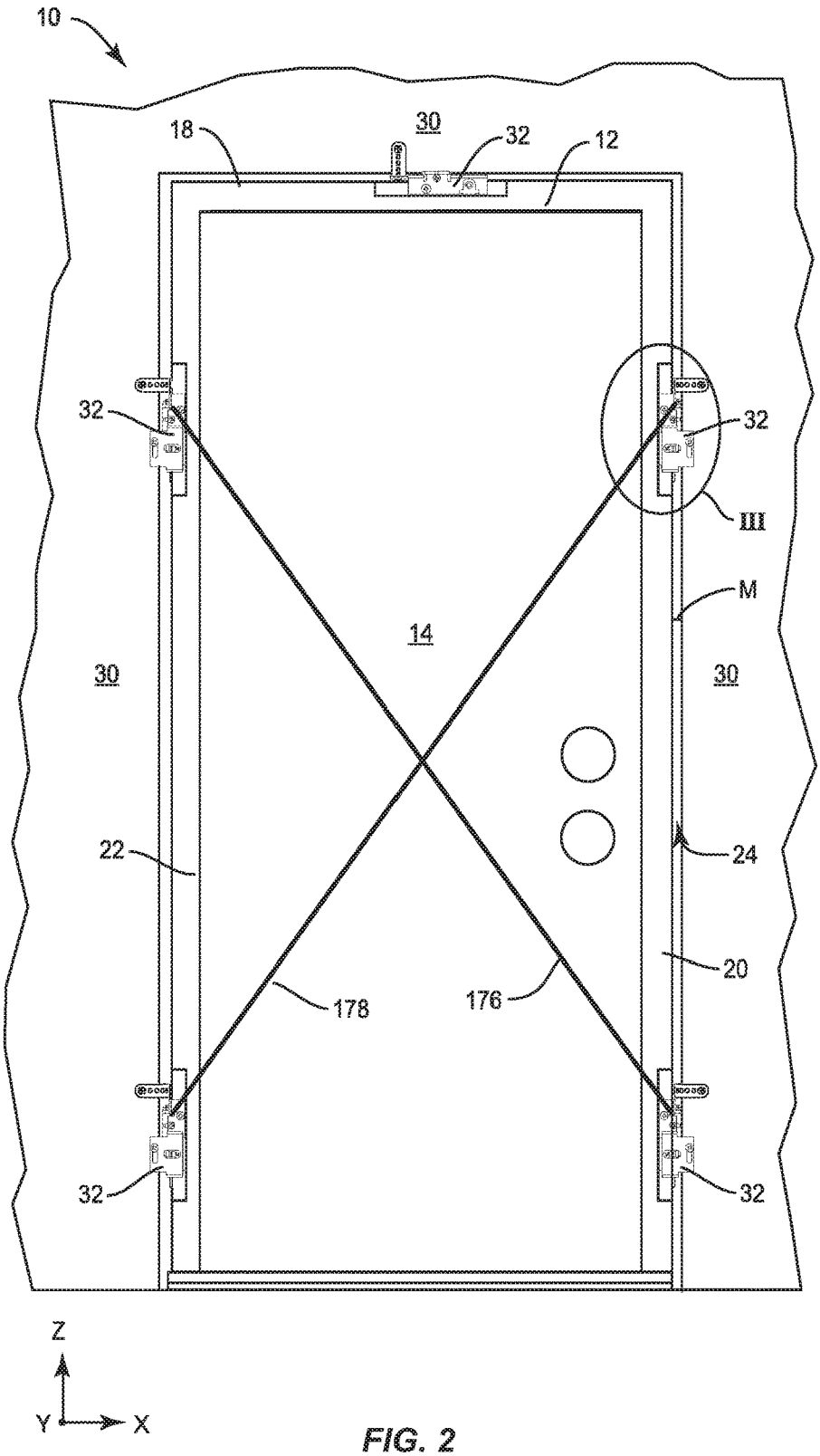
FIG. 2 is an exterior view of a pre-hung door installed in a rough opening using a plurality of adjustable shims.

With reference to FIG. 2, the pre-hung door 10 is shown installed within a rough opening 24 with the assistance of a plurality of adjustable shims 32, hereafter "shim(s) 32". In the illustrated embodiment, shims 32 are provided with two on either side of the frame 12, near the upper and lower ends of the frame respectively. Use of additional shims 32 along the height of the frame 12 is also possible. Use of one or more shims 32 along the header 18 is also possible. The shims 32 are designed to take up the space between the frame 12 and the edges of the rough opening 24. This space may be referred to as the margin M. The direction substantially normal to the back of the frame 12, along which the magnitude of the margin M is measured, may be referred to as the margin direction. In some embodiments the shims 32 may also be useful for adjusting portions of the pre-hung door 10 into and out of the rough opening 24 along a direction perpendicular to the margin direction, which may be referred to herein as the plumb direction. The plumb direction is along the Y-axis in FIG. 2. The margin direction is along the X-axis for shims 32 on the jambs 20, 22, and the margin direction is along the Z-axis for the shim 32 shown on the header 18.

As mentioned above, the pre-hung door 10 includes a frame 12 having a latch-side jamb 20 and a hinge-side jamb 22. The jambs 20, 22 may be referred to more generally by the term "frame member," to include any generally vertical portion of the frame 12, such as jambs, mullions, astragals, etc., as well as the generally horizontal header 18. As shown in the detailed view of FIG. 3, the frame member (hereafter labeled 34) includes a front face 36 and a back face 38. As used herein, the terms "front" and "back" are used relative to the X-axis, where the front face 36 faces the middle of the pre-hung door 10 and the back face 38 faces away from the middle of the pre-hung door. The rough opening 24 may be further defined by a pair of studs 26 (also referred to as the rough opening frame). The term "stud" is used broadly herein as the structural element providing an inside face 40 to the rough opening 24, where the inside face is configured to oppose the back face 38 of respective frame members 34. For example, in masonry block construction a spacer board between the blocks that form the rough opening and frame, may be considered a stud for the purposes of this disclosure. Sheathing 30, such as wood paneling or sheetrock, may be attached to the studs 26 on one or both of the interior and exterior sides thereof. The terms "interior" and "exterior" are used in relation to the Y-direction and should be understood relative to the building having the rough opening 24. The illustrated pre-hung door 10 is shown as an in-swing door, but the shims 32 described herein could also be used with out-swing doors. According to one embodiment, the shims 32 may be provided as part of the pre-hung door 10. Therefore, the shims 32, or at least portions thereof, may be mounted to the frame members 34 when the pre-hung door 10 arrives on a construction site.

Figure 4:
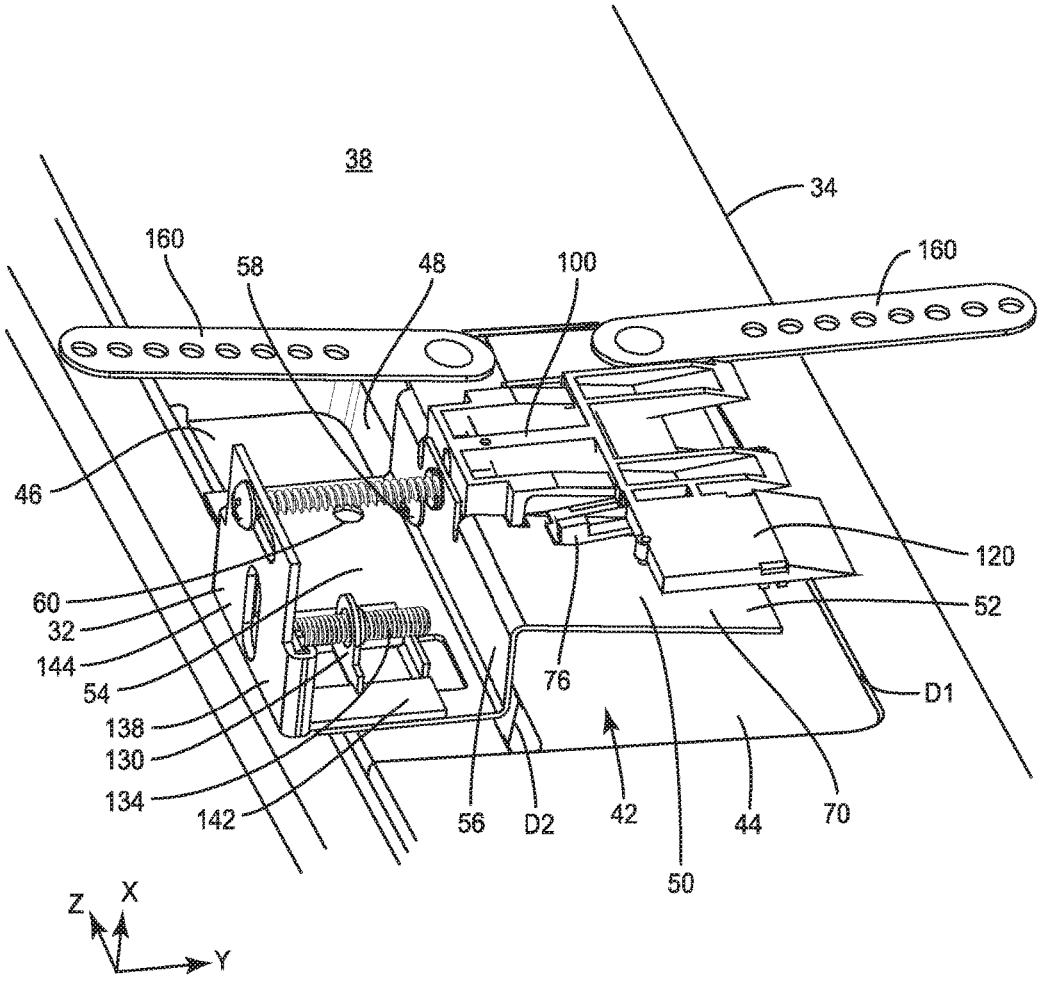
FIG. 4 is a perspective view of an adjustable shim mounted to a frame member of a pre-hung door.

FIG. 4 shows a perspective view of the shim 32 mounted to the frame member 34. To accommodate the shim 32, the back face 38 of the frame member 34 may include respective receiving recesses 42 formed into the back face. The receiving recesses 42 may include a first surface 44 substantially parallel with the back face 38 and inset from the back face by a distance D1 along the margin direction. A second surface 46 may be substantially parallel with the back face 38 and offset inward from the back face more than the first surface 44. The second surface 46 may be inset from the first surface 44 by a distance D2 along the margin direction. A third surface 48 of the receiving recess 42 may be substantially perpendicular to the back face 38 and provide a riser from the second surface 46 to the first surface 44. One or ordinary skill in the art will appreciate that the shim 32 may alternatively be mounted within a receiving recess formed into a member, such as a stud 26, that defines part of the rough opening 24 and act to press against a frame member 34.

Figure 5:
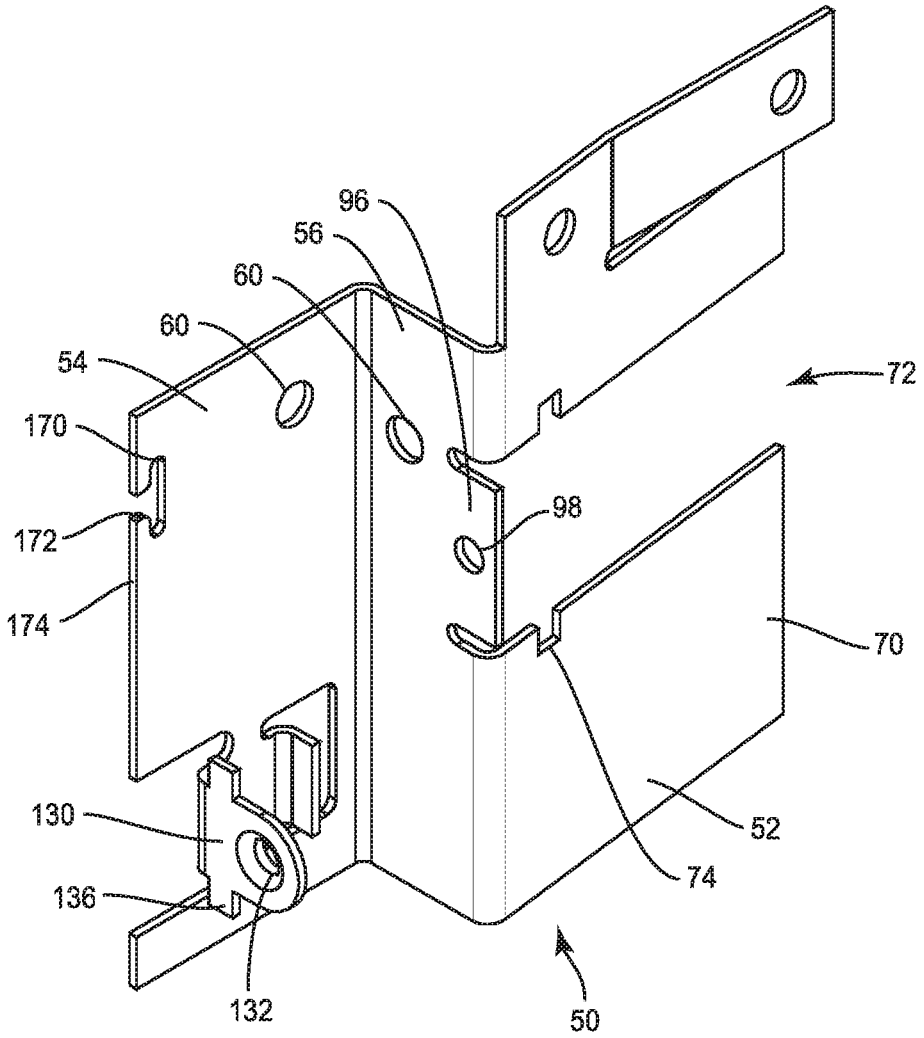
FIG. 5 is a back perspective of a base bracket of the adjustable shim of FIG. 4.

With reference to FIGS. 4 and 5, the shim 32 may include a base bracket 50 configured to mount the shim to a corresponding frame member 34. The base bracket 50 may include a shimming portion 52, a plumb adjustment portion 54, and a mounting portion 56 provided between the shimming portion and the plumb adjustment portion. The base bracket 50, and hence the shim 32, may be mounted to the frame members 34 within respective receiving recesses 42 with one or more mounting fasteners 58. The mounting fasteners may pass through one or more mounting apertures 60 provided through the base bracket 50. In FIG. 4, a mounting fastener 58 is shown attaching the mounting portion 56 of the base bracket 50 to the third surface 48 of the receiving recess 42. A mounting aperture 60 is also provided in the plumb adjustment portion 54 for accepting a mounting fastener (not shown) and attaching the plumb adjustment portion to the second surface 46 of the receiving recess 42. FIG. 4 also shows that the shimming portion 52 of the base bracket 50 may be positioned on the frame member 34 to correspond with the first surface 44 of the receiving recess 42.

The shimming portion 52 of the base bracket 50 supports the components involved in the margin filling function of the shim 32. The shimming portion 52 may comprise a plate 70. The plate 70 may be configured to be angled, i.e. provided at a non-zero angle, relative to the first surface 44 of the receiving recess 42. Thus the plate 70 would also be angled with respect to the back face 38 of the frame member 34. In one embodiment, the plate 70 is angled approximately 7 degrees from parallel with the back face 38. As seen in FIG. 5, the plate 70 may include a channel 72 extending through the plate. The channel 72 may be configured to guide the travel of other components generally along the plumb direction of the shim 32. The channel 72 may also include one or more guide notches 74.

Figure 6:
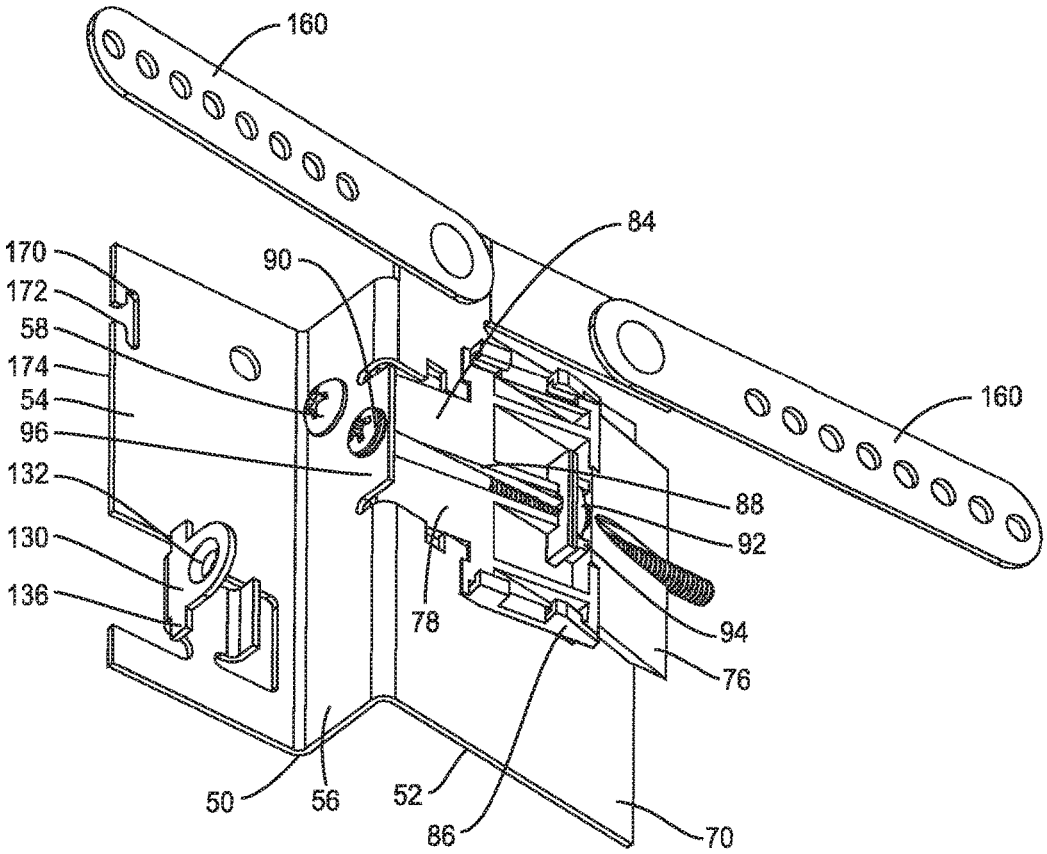
FIG. 6 is a first partial assembly view of the adjustable shim of FIG. 4.
Figure 7:
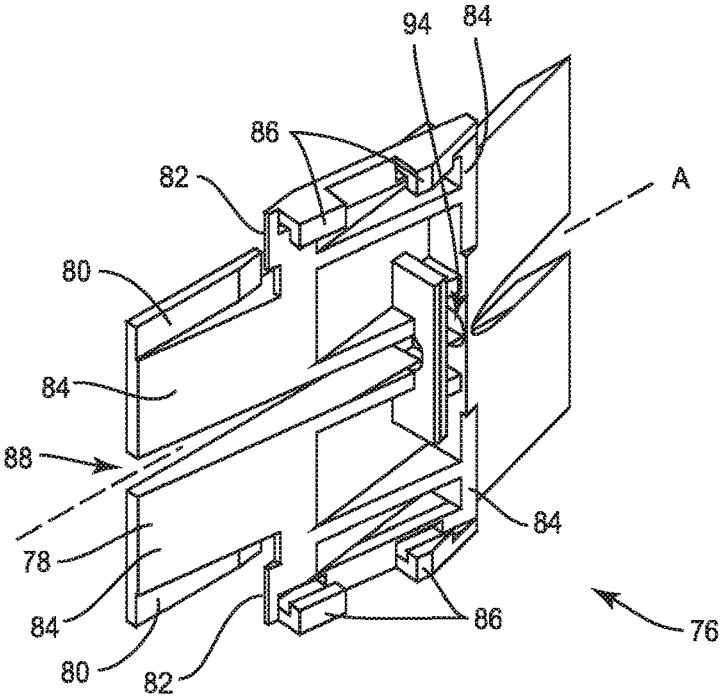
FIG. 7 is a back perspective of an inner shim of the adjustable shim of FIG. 4.
Figure 8:
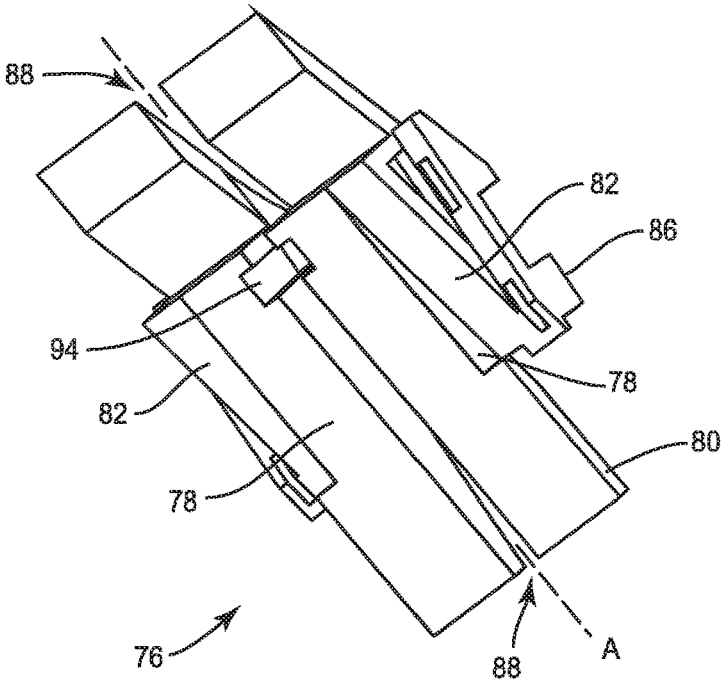
FIG. 8 is a front perspective of the inner shim of FIG. 7.
Figure 9:
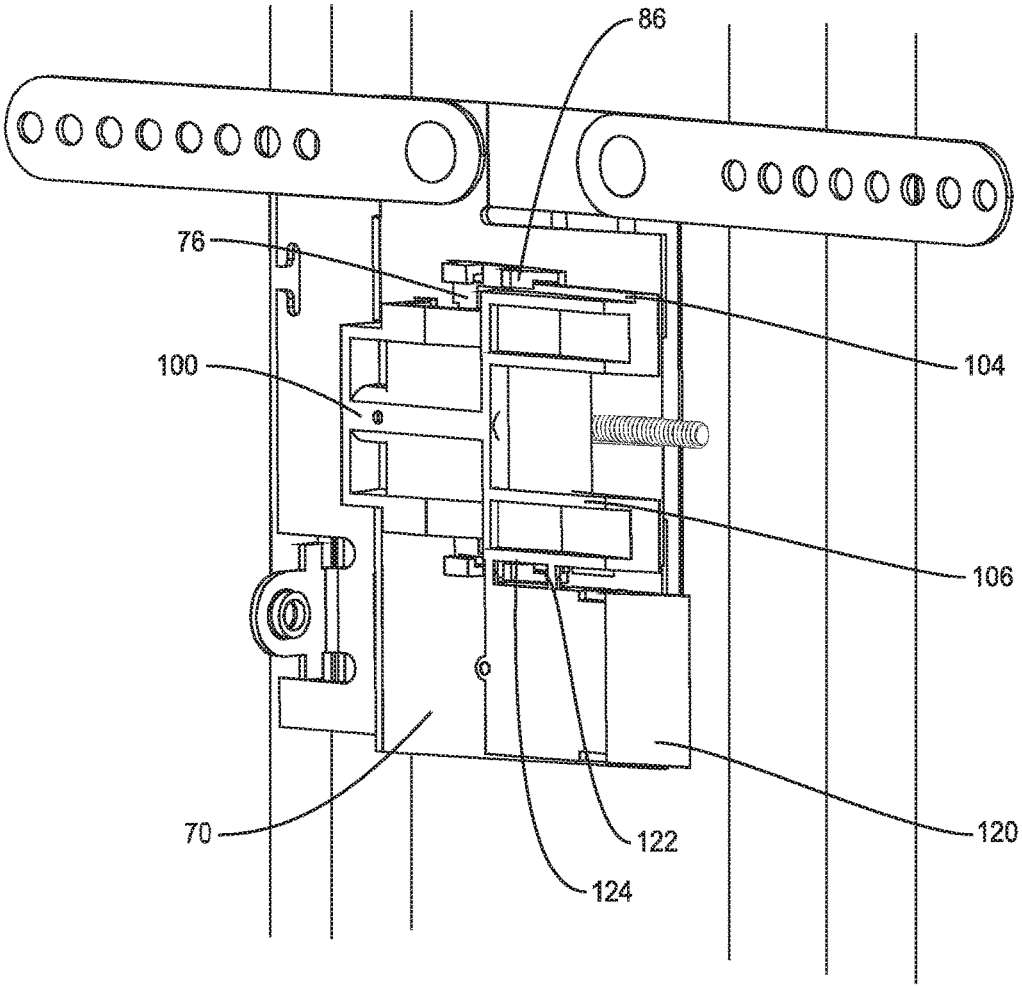
FIG. 9 is a second partial assembly view of the adjustable shim of FIG. 4.

Turning to FIGS. 6-8, an inner shim 76 may be slideably positioned on the shimming portion 52 of the base bracket 50. The inner shim 76 may have guide region 78 configured to fit closely within the channel 72. Positioning flanges 80 may extend from the guide region 78 to fit below the plate 70 of the base bracket 50, and help retain the inner shim 76 as part of the shim 32. The inner shim 76 may include one or more inner support surfaces 82 (FIG. 8) that can be co-planar with one another and configured to contact the outside of the plate 70. The inner shim 76 also includes one or more outer support surfaces 84 that can be co-planar to one another. The plane P1 (see FIG. 12) formed by the outer support surfaces 84 may have retention arms 86 extending therefrom. A second plane P2 (see FIG. 12) of the inner support surfaces 82 and the first plane P1 of the outer support surface 84 may be tapered toward one another to provide the inner shim 76 with a generally wedge-shaped design. In the illustrated embodiment, the inner shim 76 is mirror symmetric about a longitudinal axis A. Generally, a clearance region 88 is created adjacent to the longitudinal axis A. The clearance region 88 is flanked by the two halves of the inner shim 76 which are connected by bridging portions.

As seen in FIG. 6, a first actuator, such as a first adjustment screw 90, is operably attached between the base bracket 50 and the inner shim 76. In the illustrated embodiment, the first adjustment screw 90 passes through the clearance region 88 of the inner shim 76. The first adjustment screw 90 mates with a nut 92 captured by a cavity 94 within the inner shim 76. In other embodiments, the inner shim 76 may itself include a threaded bore. The first adjustment screw 90 passes through the base bracket 50, for example, through a tab 96 having an actuator opening 98 (FIG. 5) formed as part of the mounting portion 56. The first adjustment screw 90 is in threaded engagement with the nut 92 located within the cavity 94. The nut 92 may be fixed relative to the inner shim 76 because of the configuration of the cavity 94. Therefore, rotation of the first adjustment screw 90 causes the nut 92 to travel along the shaft of the first adjustment screw. As a result, the inner shim 76 is made to translate substantially linearly relative to the plate 70 of the base bracket 50, traveling along the plumb direction. Again, the plumb direction is generally equivalent to the interior/exterior direction as defined by a building having a rough opening 24 (FIG. 2).

Turning to FIGS. 9-12, an outer shim 100 may be provided on the inner shim 76. The outer shim 100 may have a bottom surface 102 (FIG. 11) configured for contacting the outer support surface 84 of the inner shim 76. The outer shim 100 may have wings 104 configured to slideably interact with the retention arms 86 of the inner shim 76. This interaction allows the inner shim 76 to slide relative to the outer shim 100 while at least partially retaining the outer shim as part of the assembled shim 32.

The outer shim 100 may further comprise one or more generally coplanar abutment surfaces 106 opposite the bottom surface 102. In some embodiments, the abutment surfaces 106 are intended to contact the inside face 40 of the stud 26. The plane of the bottom surface 102 (see P1 in FIG. 12) and the plane of the abutment surfaces 106 (see P3 in FIG. 12) may be tapered with respect to one another to provide the outer shim 100 with a generally wedge-shaped design. The cumulative orientation and arrangement of the plate 70, the inner and outer support surface 82, 84 of the inner shim 76, and the bottom surface and the abutment surfaces 102, 106 of the outer shim 100 are intended to result in the plane P3 of the abutment surfaces 106 being substantially parallel with back face 38 of the frame member 34.

Figure 10:
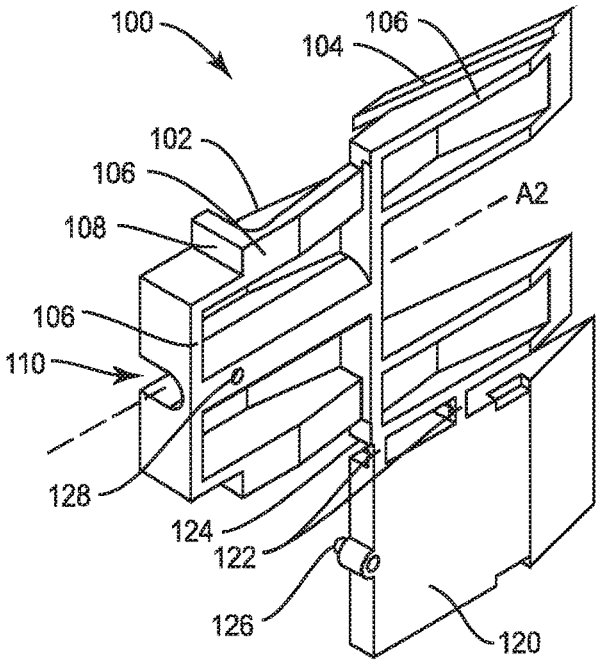
FIG. 10 is a back perspective of an outer shim of the adjustable shim of FIG. 4.
Figure 11:
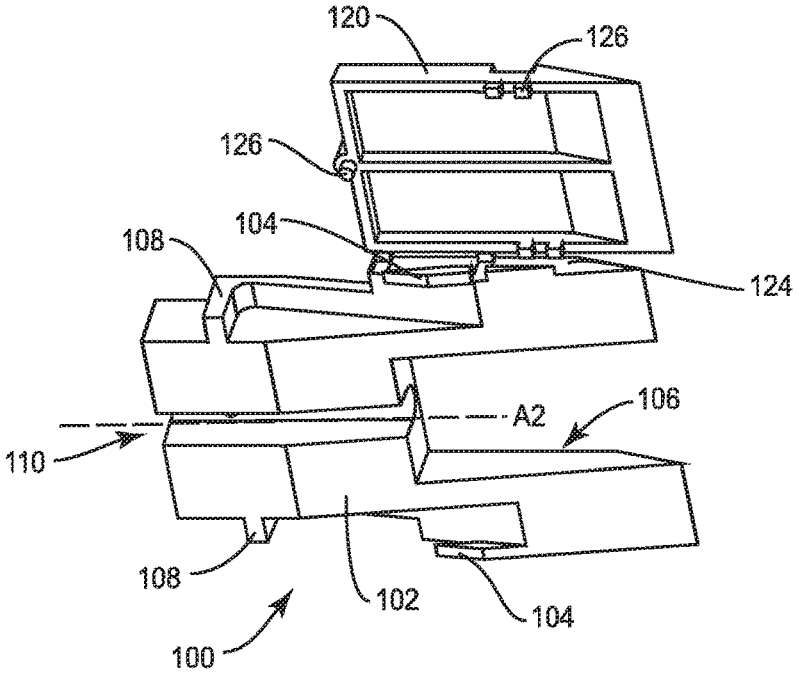
FIG. 11 is a front perspective of the outer shim of FIG. 10.
Figure 12:
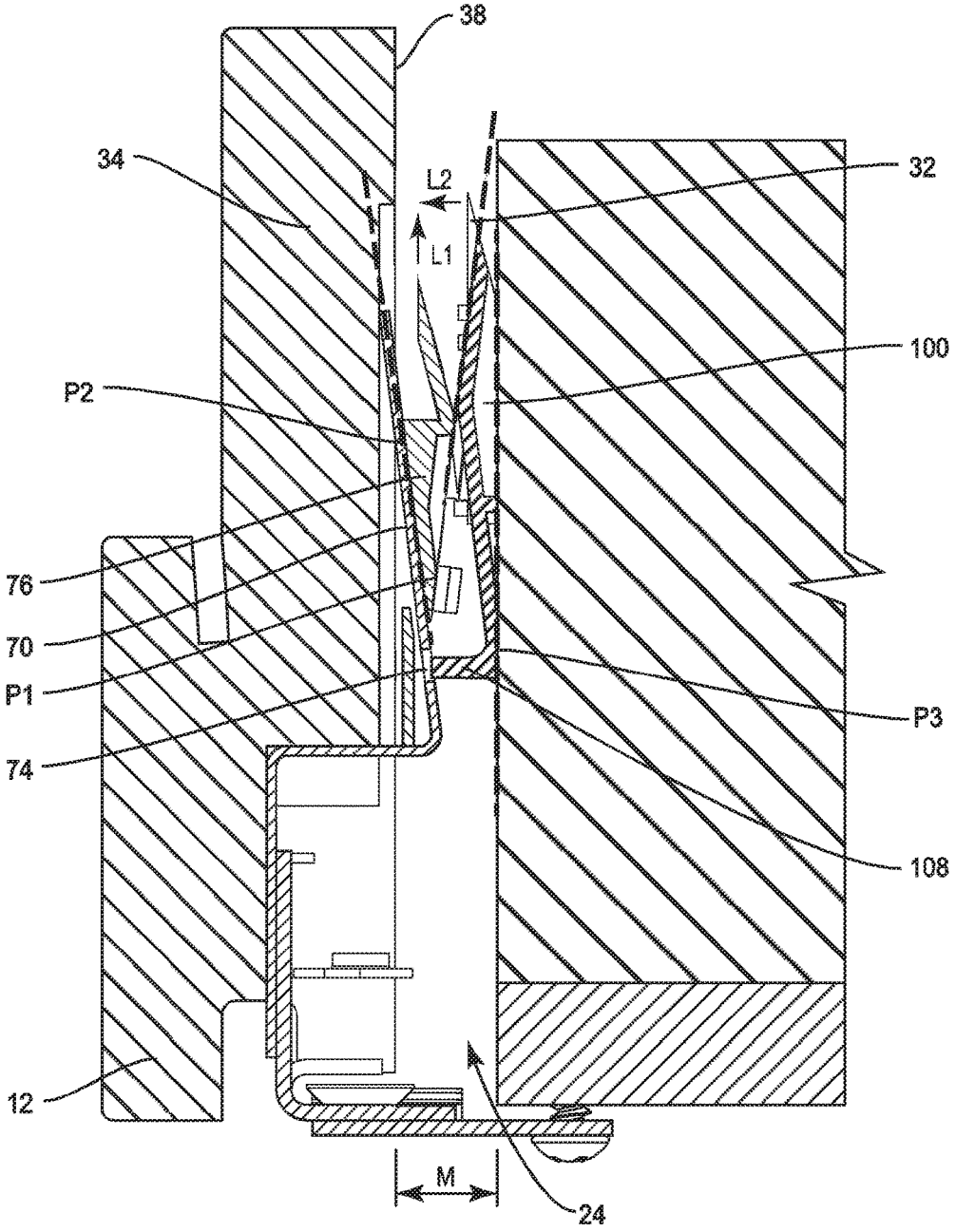
FIG. 12 is a detailed cross section taken at line XII-XII in FIG. 3.

As seen in FIGS. 10-12, the outer shim 100 may also include at least one guide leg 108. The guide leg 108 is configured to fit within the guide notches 74 of the plate 70 as seen in FIG. 12. The guide leg 108 slides within the guide notch 74 to substantially restrict motion of the outer shim 100 to motion along the margin direction, perpendicular to the back face 38 of the frame member 34. The interaction between the guide leg 108 and a respective guide notch 74 may minimize motion of the outer shim 100 along the plumb direction, parallel with the back face 38.

The outer shim 100 may have a clearance recess 110 generally bisecting the outer shim 100 along a longitudinal axis A2. The clearance recess 110 is configured to at least partially surround portions of the first adjustment screw 90 (FIG. 6), at least when the outer shim 100 is in a lowered position.

Figure 3:
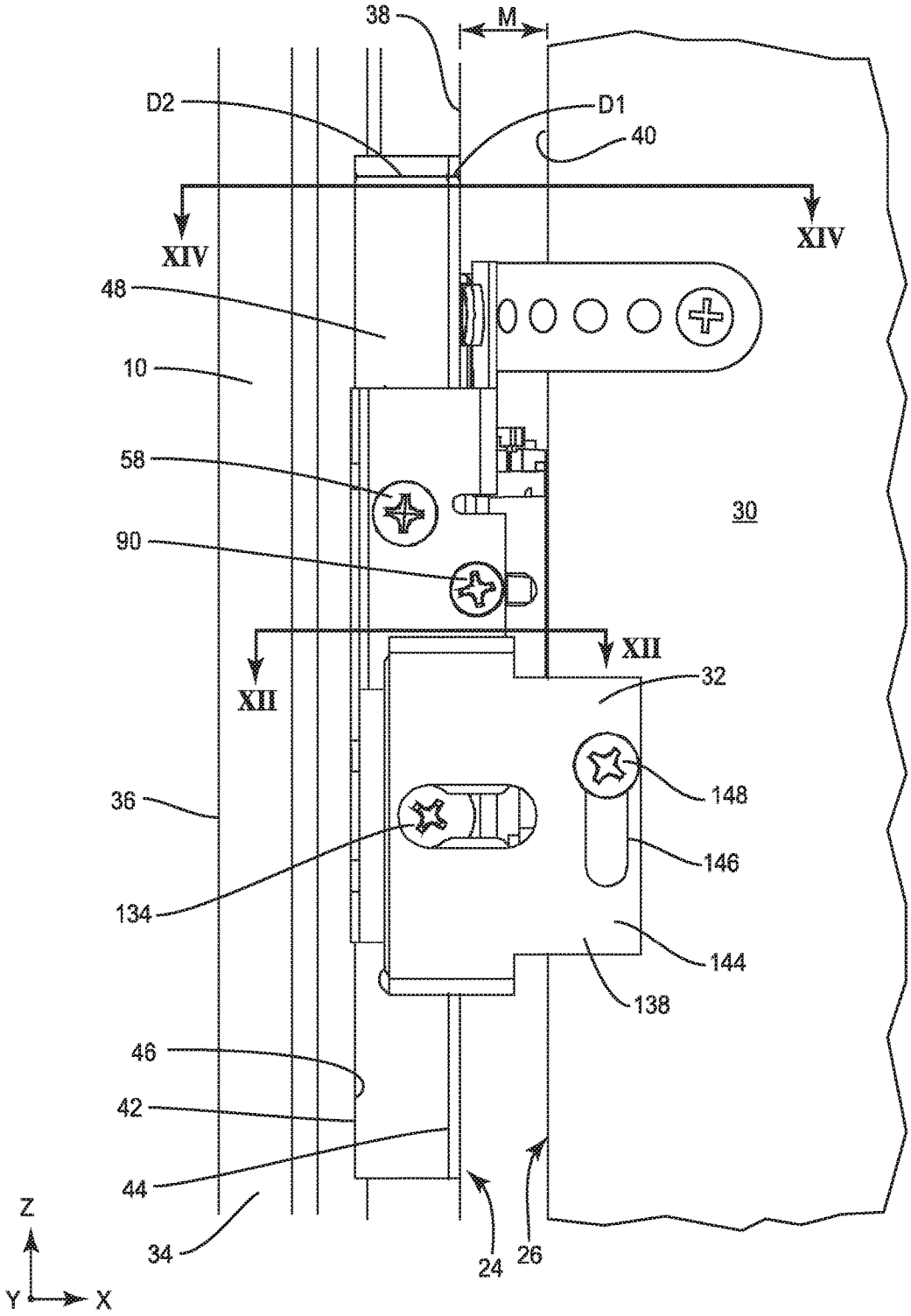
FIG. 3 is a detailed view of area III from FIG. 2.

FIG. 12 shows a cross section at a location XII-XII of FIG. 3. FIG. 12 generally shows the shim 32 in a maximum adjusted position. This position may also be referred to as a raised position or an extended position, configured to take up the margin M. To contract the shim 32, the first adjustment screw 90 (FIGS. 3 and 6) is rotated. As discussed above, rotation of the first adjustment screw 90 causes the inner shim 76 to translate. In the present scenario, the inner shim 76 would translate in the direction indicated by the arrow L1. Because of the relative shape and arrangement of the inner shim 76, the outer shim 100, and the plate 70, translation of the inner shim 76 in the direction L1 causes the outer shim 100 to lower relative to the back face 38 of the frame member 34 along direction L2. This lowering motion L2 is generally perpendicular to the translational motion of the inner shim 76 along direction L1.

The shim 32 may be similarly expanded by reversing the motions discussed above as the first adjustment screw 90 is rotated in an opposite direction. In the illustrated embodiment, the inner shim 76 would effectively wedge itself between the plate 70 and the outer shim 100 to extend the shim 32. During installation, the shim 32 may be delivered in a generally lowered position and adjusted into a relatively extended position after being set in the rough opening 24 for placement of the abutment surface 106 of the outer shim 100 against the inside face 40 of the stud 26. Put another way, adjustments can be made such that the shim 32 takes up the appropriate margin M between the frame 12 and the rough opening 24. Rotation of the first actuator may also be described as resulting in a change in the combined height of the inner shim 76 and the outer shim 100 as a result of translation of the inner shim. While the first actuator is shown in the form of a first adjustment screw 90, other actuators capable of converting rotational motion to translational motion may be used, such as a cam or a series of gears.

Returning to FIGS. 9-11, in some embodiments, a supplemental shim 120 is removably attached to the outer shim 100. The supplemental shim 120 may be provided to selectively increase the maximum height or expansion of the shim 32 relative to the back face 38 of the frame member 34. The supplemental shim 120 may be formed integrally with the outer shim 100. For example, a web 122 may attach the supplemental shim 120 to a side portion 124 of the outer shim 100. If the margin M (FIG. 3) between the frame 12 and the stud 26 is greater than an initial maximum operating height, for example ½ inch, the supplemental shim 120 may be separated from the side portion 124 by breaking the web 122. The supplemental shim 120 may then be stacked on the abutment surface 106 of the outer shim 100 to provide additional shimming thickness and increase the maximum operating height of the shim 32. In one example, the supplemental shim 120 may provide an additional ⅛ inch thickness. One or more features may be provided to help attach the supplemental shim 120 to the abutment surface 106. For example, alignment posts 126 may extend from the bottom of the supplemental shim 120 and be configured to correspond with one or more receiving portions 128 on the outer shim 100. The receiving portions 128 may take the form of holes, openings, recesses, channels, slots, grooves, indents, etc. In some embodiments, one or more of the alignment posts 126 may be provided with snap hooks, clamping features or clip features configured to engage at least one of the receiving portions 128 and thereby connect the supplemental shim 120 with the outer shim 100.

Figure 13:
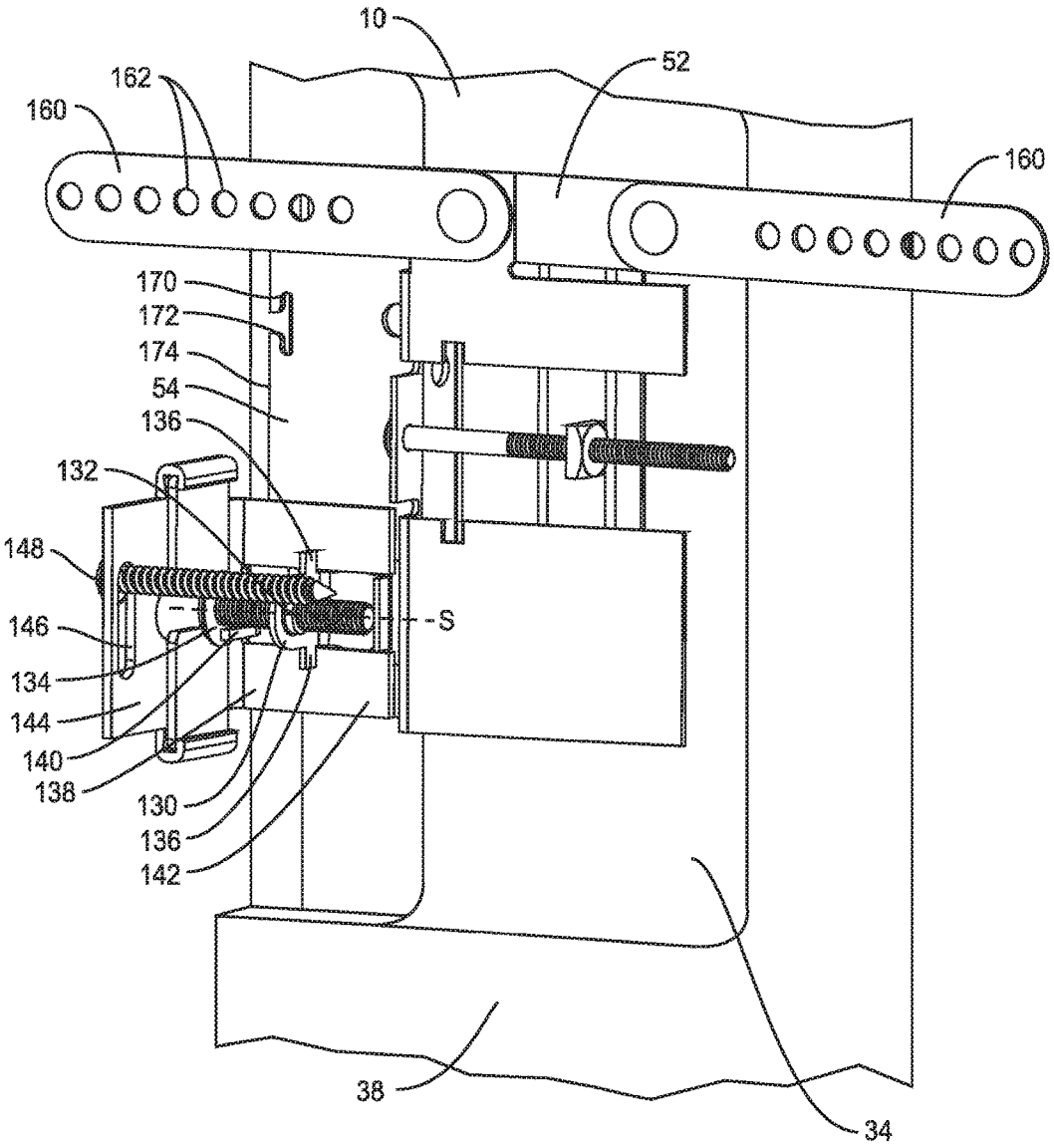
FIG. 13 is a third partial assembly view of the adjustable shim of FIG. 4.

Turning to FIG. 13 a partial assembly of the shim 32 is shown to highlight optional features configured to facilitate adjustment of the plumb condition of the pre-hung door 10. The pre-hung door 10 is plumb when it is vertical and substantially co-planar with the rough opening 24 (FIG. 2). The plumb condition of the pre-hung door 10 is adjusted by moving portions of the frame 12 along an axis normal to the plane of the pre-hung door 10, i.e. along the plumb direction.

This direction of motion may also be referred to as movement into and out of the rough opening along an interior/exterior direction of the building.

In the illustrated embodiment, the plumb adjustment portion 54 of the base bracket 50 includes a projection 130 extending from the outer surface of the plumb adjustment portion and substantially perpendicular to the back face 38 of the frame member 34. The projection 130 may include a threaded aperture 132 for receiving a second actuator, such as a second adjustment screw 134. When the second adjustment screw 134 engages the threaded aperture 132, the screw axis S corresponds with the interior/exterior direction of the building (see FIG. 14). Additionally, guide arms 136 may extend from the projection 130 to slideably receive a plumb adjustment bracket 138 between the guide arms and the outer surface of the plumb adjustment portion 54. The plumb adjustment bracket 138 includes an elongated opening 140 to nest the second adjustment screw 134, which mates to the threaded aperture 132. The plumb adjustment bracket 138 may be formed as a unitary component or may be formed from two or more separate brackets. In the illustrated embodiment, the plumb adjustment bracket 138 includes an L-shaped bracket 142 configured to slide along the screw axis S relative to the base bracket 50. The plumb adjustment bracket 138 also includes an attachment bracket 144. The attachment bracket 144 is configured to slide relative to the L-shaped bracket 142 along the direction perpendicular to the screw axis S. The attachment bracket 144 is configured to extend outward from the frame member 34 and overlap the sheathing 30 on the exterior of the rough opening 24 (see FIG. 14). An attachment aperture 146 in the attachment bracket 144 allows passage of an anchoring fastener 148. The anchoring fastener 148 is used to fix the attachment bracket 144 to the sheathing 30. Once the plumb adjustment bracket 138 fixed to the sheathing 30, rotation of the second adjustment screw 134 results in substantially linear movement of the frame 12 perpendicular to the face of the sheathing 30.

Figure 14:
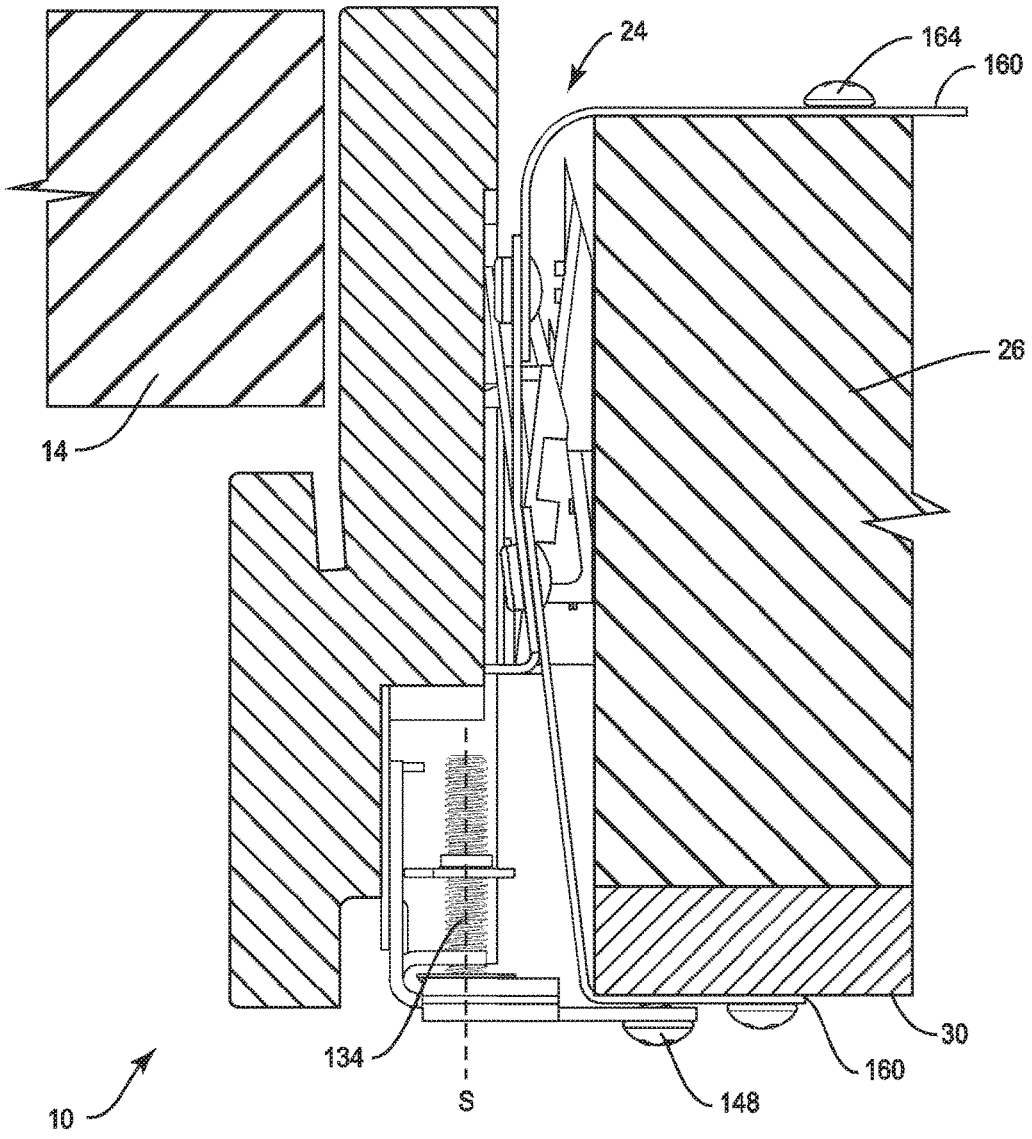
FIG. 14 is a cross section taken at line XIV-XIV in FIG. 3.

Staying with FIGS. 13 and 14, the shim 32 may optionally include securing straps 160. The securing straps 160 may be rotatably attached, by rivets for example, to the shimming portion 52 of the base bracket 50. In the illustrated embodiment, two securing straps 160 are provided for each shim 32. One securing strap 160 may be for attachment to the respective interior and exterior sheathing 30 of the rough opening 24. By rotatably mounting the securing straps 160 to the base bracket 50, the straps 160 can be rotated substantially parallel with the length of a corresponding frame member 34 during shipping and handling. Thus, the straps 160 may be generally out of the way and not projecting past the interior or exterior face of the pre-hung door 10 prior to installation. Once the pre-hung door 10 is properly positioned within the rough opening 24 using one or both of the first and second adjustment screws 90, 134, the straps 160 can be rotated away from the frame center line into relatively horizontal orientations as shown in FIG. 13. The straps 160 can then be bent away from the frame member 34 to overlap both the exterior sheathing 30 and rough stud interior edge. Holes 162 along the length of each strap 160 may be used for placement of fastening anchors 164 to fix the pre-hung door 10 to the rough opening 24.

In one embodiment, the shim 32 is provided with optional features that may assist an installer assess the planar condition of the pre-hung door 10. For example, the plumb adjustment portion 54 of the base bracket 50 may include a slot 170 located near the top edge of the plumb adjustment portion. An opening 172 extends between a side edge 174 of the plumb adjustment portion 54 and the slot 170. The slot 170 is configured to receive and secure an end of a string, or similar cord, rope, etc. When the pre-hung door 10 is provided with shims 32 near the four corners thereof as shown in FIG. 2, a first string 176 may be attached to span between the shim 32 at one upper corner of the pre-hung door 10, and the shim 32 to the opposing diagonal lower corner of the pre-hung door. A second string 178 may be placed likewise between slots 170 in shims 32 at the remaining two corners. The pre-hung door 10 is then determined to be in a substantially planar condition if the two strings 176, 178 almost touch or lightly touch as they cross one another.

Exemplary embodiments have been discussed above in terms of the structure and function of adjustable shims 32 and pre-hung doors 10 that include one or more of the shims. The structures, features, and functions discussed above may also lend themselves to novel methods of installing a pre-hung door within a rough opening in a building. Example steps for installation include the rotation of one or both the first and second actuators of the shim. Other additional or alternative steps may arise from the process of fixing the pre-hung door to the rough opening or a frame thereof using the rotatable straps 160 described above. Alternative or additional method steps may also arise from the use of the supplemental shim 120 as discussed above.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. An adjustable shim, the adjustable shim comprising:

a base bracket configured to mount the adjustable shim to a pre-hung door or a rough opening;

an inner shim;

an outer shim;

a first actuator operably attached between the base bracket and the inner shim;

a plumb adjustment bracket slideably attached to the base bracket and configured for attachment to a rough opening frame that defines a rough opening; and a second actuator configured to convert rotational motion of the second actuator into linear motion, sliding the plumb adjustment bracket relative to the base bracket along a direction into and out of the rough opening, wherein at least one of the inner shim and the outer shim is tapered, wherein rotation of the first actuator translates the inner shim substantially linearly relative to the outer shim, thereby adjusting a combined height of the inner shim and the outer shim.

2. The adjustable shim of claim 1, wherein the first actuator is a first adjustment screw.

3. The adjustable shim of claim 1, wherein a first portion of the base bracket is configured to be mounted at non-zero angle relative to a back face of a frame member of the pre-hung door.

4. The adjustable shim of claim 3, wherein the first portion is a plate including a channel in which the inner shim is positioned.

5. The adjustable shim of claim 3, wherein the outer shim comprises guide legs, and the first portion of the base bracket includes notches therethrough, wherein the guide legs are positioned to travel within the notches such that the outer shim moves perpendicular to the base bracket.

6. The adjustable shim of claim 1, further comprising:

a supplemental shim removably attached to the outer shim to selectively increase a maximum height of the adjustable shim.

7. The adjustable shim of claim 6, wherein the supplemental shim is provided integrally with the outer shim, and wherein the supplemental shim is configured to be separated from a first portion of the outer shim and stacked on a second portion of the outer shim to provide additional shim thickness to accommodate larger margins between the pre-hung door and a rough opening.

8. The adjustable shim of claim 1, wherein the base bracket comprises a slot extending into the base bracket from an edge thereof, wherein the slot is configured for securing a string used to judge a planar condition of the pre-hung door.

9. The adjustable shim of claim 1, further comprising: at least one strap rotatably attached to the base bracket for attaching the adjustable shim to a rough opening frame.

10. An adjustable shim, the adjustable shim comprising:

a base bracket configured to mount the adjustable shim to a pre-hung door or a rough opening;

an inner shim;

an outer shim;

a first actuator operably attached between the base bracket and the inner shim; and at least one strap rotatably attached to the base bracket for attaching the adjustable shim to a rough opening frame, wherein at least one of the inner shim and the outer shim is tapered, wherein rotation of the first actuator translates the inner shim substantially linearly relative to the outer shim, thereby adjusting a combined height of the inner shim and the outer shim.

11. The adjustable shim of claim 10, wherein the at least one strap is bent away from the pre-hung door to overlap a portion of a face of the rough opening frame.

12. The adjustable shim of claim 10, further comprising:

a plumb adjustment bracket slideably attached to the base bracket and configured for attachment to a rough opening frame that defines a rough opening; and a second actuator for sliding the plumb adjustment bracket relative to the base bracket along a direction into and out of the rough opening.

13. The adjustable shim of claim 12, wherein the first actuator is a first adjustment screw and the second actuator is a second adjustment screw.

14. The adjustable shim of claim 10, further comprising:

a supplemental shim removably attached to the outer shim to selectively increase a maximum height of the adjustable shim.

15. A pre-hung door, comprising:

a pair of vertical frame members, a header spanning across a top of the vertical frame members;

a threshold spanning across a bottom of the vertical frame members;

a door panel hinged to one of the vertical frame members; and at least one adjustable shim, the at least one adjustable shim comprising:

a base bracket configured to mount the adjustable shim to a pre-hung door or a rough opening;

an inner shim;

an outer shim; and a first actuator operably attached between the base bracket and the inner shim, wherein at least one of the inner shim and the outer shim is tapered, wherein rotation of the first actuator translates the inner shim substantially linearly relative to the outer shim, thereby adjusting a combined height of the inner shim and the outer shim, wherein a receiving recess is formed in a back face of at least one of the vertical frame members into which a respective one of the at least one adjustable shim is mounted.

16. The pre-hung door of claim 15, wherein the at least one adjustable shim includes a plurality of adjustable shims, the plurality of adjustable shims attached to the pair of vertical frame members adjacent to respective upper and lower ends of each vertical frame member.

17. An entryway comprising:

at least a pair of studs, the studs at least partially defining a rough opening through a building; and the pre-hung door of claim 15 positioned within the rough opening.

18. The pre-hung door of claim 15, wherein the at least one adjustable shim further comprises:

a plumb adjustment bracket slideably attached to the base bracket and configured for attachment to a rough opening frame that defines a rough opening; and a second actuator configured to convert rotational motion of the second actuator into linear motion, sliding the plumb adjustment bracket relative to the base bracket along a direction into and out of the rough opening.

19. The pre-hung door of claim 15, wherein the at least one adjustable shim further comprises:

at least one strap rotatably attached to the base bracket for attaching the adjustable shim to a rough opening frame.

20. The pre-hung door of claim 15, wherein the at least one adjustable shim further comprises:

a supplemental shim removably attached to the outer shim to selectively increase a maximum height of the adjustable shim.

* * * * *